US005560474A

United States Patent [19]

Thomas et al.

[11] Patent Number: 5,560,474

[45] Date of Patent: Oct. 1, 1996

[54] ELECTRO/MECHANICAL ACTUATOR FOR CIRCUIT DISCONNECT/CONNECT APPARATUS FOR OVERHEAD POWER LINES

[75] Inventors: Barry Thomas; James Ross, both of Charlotte; Andrew S. Panto, Matthews; W. Roy Rinehart, Charlotte, all of N.C.

[73] Assignee: Southern Electrical Equipment Company, Charlotte, N.C.

[21] Appl. No.: 290,618

[22] Filed: Aug. 15, 1994

[51] Int. Cl.[6] ..... H01H 31/00

[52] U.S. Cl. ..... 200/48 A; 200/48 KB; 200/49; 200/48 R

[58] Field of Search ..... 200/48 R, 48 P, 200/48 A, 48 KB, 48 V, 48 SB, 48 CB, 49, 329, 331, 332, 336, 337, 338

[56] References Cited

U.S. PATENT DOCUMENTS

| | | | |
|---|---|---|---|
| 2,462,342 | 2/1949 | Trogner . | |
| 3,226,499 | 12/1965 | Curtis et al. . | |
| 3,243,534 | 3/1966 | Turner . | |
| 3,255,332 | 6/1966 | Curtis et al. . | |
| 3,382,330 | 5/1968 | Bernatt et al. . | |
| 3,388,297 | 6/1968 | Curtis et al. . | |
| 3,409,815 | 11/1968 | Wright et al. . | |
| 3,530,263 | 9/1970 | Joyce . | |
| 3,647,996 | 3/1972 | Bernatt et al. | 200/48 R |
| 3,780,625 | 12/1973 | Weston et al. | 200/48 R |
| 4,095,061 | 6/1978 | Bridges . | |
| 4,110,579 | 8/1978 | Frink et al. . | |
| 4,357,505 | 11/1982 | Bridges | 200/48 KB |

*Primary Examiner*—David J. Walczak
*Attorney, Agent, or Firm*—Nixon & Vanderhye

[57] ABSTRACT

The apparatus includes contact blades at different elevations on a utility pole rotatable between electrical connection and disconnection positions vis-a-vis contact members. To rotate the contact blades, an electromechanical linear actuator extends a clevis and crank arm to rotate a vertically extending shaft coupled to another crank and a lever arm to rotate the insulators on which the contact blades are mounted. The linear actuators are carried by support structure high on the utility pole and, by rotating the vertical shafts, the insulators and contact blades at each phase are simultaneously rotated.

15 Claims, 8 Drawing Sheets

ELECTRO/MECHANICAL ACTUATOR FOR CIRCUIT DISCONNECT/CONNECT APPARATUS FOR OVERHEAD POWER LINES

TECHNICAL FIELD

The present invention relates to an actuating mechanism for disconnecting and connecting an electrical circuit carried on an overhead power line and particularly relates to linear actuators and mechanical linkages coupled to the actuator, all carried adjacent an upper end of a power line pole for effecting electrical disconnection/connection of movable contact blades and contact members.

BACKGROUND

Overhead power lines typically operate in a three-phase system, with each phase disposed on the pole in vertically spaced relation to one another. Each phase carries a number of ways. This arrangement requires group-actuated switches such that the corresponding ways in the phases can be simultaneously opened or closed. Typically, each switch includes a contact blade which extends from an electrical line mounted on an insulator carried by support structure on the pole for disconnection/connection with a contact member centrally located on the support structure in electrical contact with one or more other ways. The movable contact blades are group-operated or ganged together so that the switches of the three phases may be simultaneously disconnected or connected.

Commonly, vertical shafts carried by the support structure on the pole interconnect the movable switch blades such that, by rotating the vertical shafts, the blades may be moved between switch-open and switch-closed positions. One method for simultaneously opening and closing three disconnect/connect switches via the rotation of a single vertical shaft includes an electric motor mounted at the base of the pole. This traditional solution enables direct replacement of a manually-actuated handle with a motor operator. However, this is an expensive solution because of the requirement for transitional piping, couplings and guide plates between the motors and switches. Security also becomes an issue with the motors located close to ground level. Installation time, similarly, is longer and more costly. A second alternative for rotating the vertical shafts has included a hydraulic linear actuator. Hydraulic components, however, include expensive pumps, valves, cylinders and other miscellaneous equipment. Hydraulically-actuated systems have demonstrated unreliability caused by hydraulic leaks. Difficulties in setting up and adjusting the system are also encountered.

DISCLOSURE OF THE INVENTION

In accordance with the present invention, there is provided an electric operated linear actuator mounted adjacent the upper end of the electric power pole on the power line support structure. The actuator is coupled to the vertical shaft through a first advantageous mechanical linkage and which vertical shaft is coupled through a second mechanical linkage through the insulators with the movable switch contact blades. Thus, for example, for a three-phase three-way system, three electrically operated linear actuators are disposed, preferably at a common elevation on the support structure, with each actuator in engagement with a vertical shaft coupled to a movable switch contact blade at each phase. The electrical control system for the electrically operated linear actuators may be disposed at the base of the pole and the actuators actuated singly or in any combination to effect the operation of the switches.

In a preferred embodiment according to the present invention, there is provided in an electrical circuit disconnect/connect apparatus for an overhead power line carried on a pole, apparatus adjacent an upper end of the pole for effecting electrical disconnection/connection of a rotatable contact blade and a contact member comprising a vertically extending shaft rotatable about a generally vertical axis, a linkage assembly coupling the shaft and the movable contact blade and operable to rotate such contact blade in response to rotation of the shaft, an electrical/mechanical linear actuator for pivotal mounting on the upper end of the pole and having an electric motor and a driveshaft movable axially and linearly in response to electrical actuation of the motor, connecting structure between the driveshaft and the vertical shaft, including a crank fixed to the vertical shaft and a clevis fixed to the driveshaft and pivotally coupled to the crank for rotating the vertical shaft to rotate the contact blade thereby to electrically connect or disconnect the movable contact blade and contact member in response to actuation of the actuator and linear movement of the driveshaft, the axis of the driveshaft and the axis of the vertical shaft being offset from one another.

In a further preferred embodiment according to the present invention, there is provided in an electrical circuit disconnect/connect apparatus for first and second phases of an overhead power line carried on a pole at different elevations therealong, apparatus adjacent an upper end of said pole for effecting substantially simultaneous electrical disconnection/connection of first and second rotatable contact blades and first and second contact members, respectively, of said first and second phases, comprising a vertically extending shaft carried by the pole for rotation about a generally vertical axis, first and second linkage assemblies coupling the shaft and the first and second movable contact blades including first and second insulators for jointly rotating the blades of the first and second phases in response to rotation of the vertical shaft, an electrical/mechanical linear actuator carried by the pole adjacent the upper end of the pole and having an electric motor and a driveshaft movable axially and linearly in response to electrical actuation of the motor, connecting structure between the driveshaft and the vertical shaft, including a crank fixed to the vertical shaft and a clevis fixed to the driveshaft and pivotally coupled to the crank for rotating the vertical shaft to substantially simultaneously electrically connect or disconnect the first and second movable contact blades and contact members in response to actuation of the actuator and linear movement of the driveshaft.

Accordingly, it is a primary object of the present invention to provide a novel and improved electrical circuit disconnect/connect apparatus for overhead power distribution lines carried on a pole.

BEST MODE FOR CARRYING OUT THE INVENTION

Figure 1:
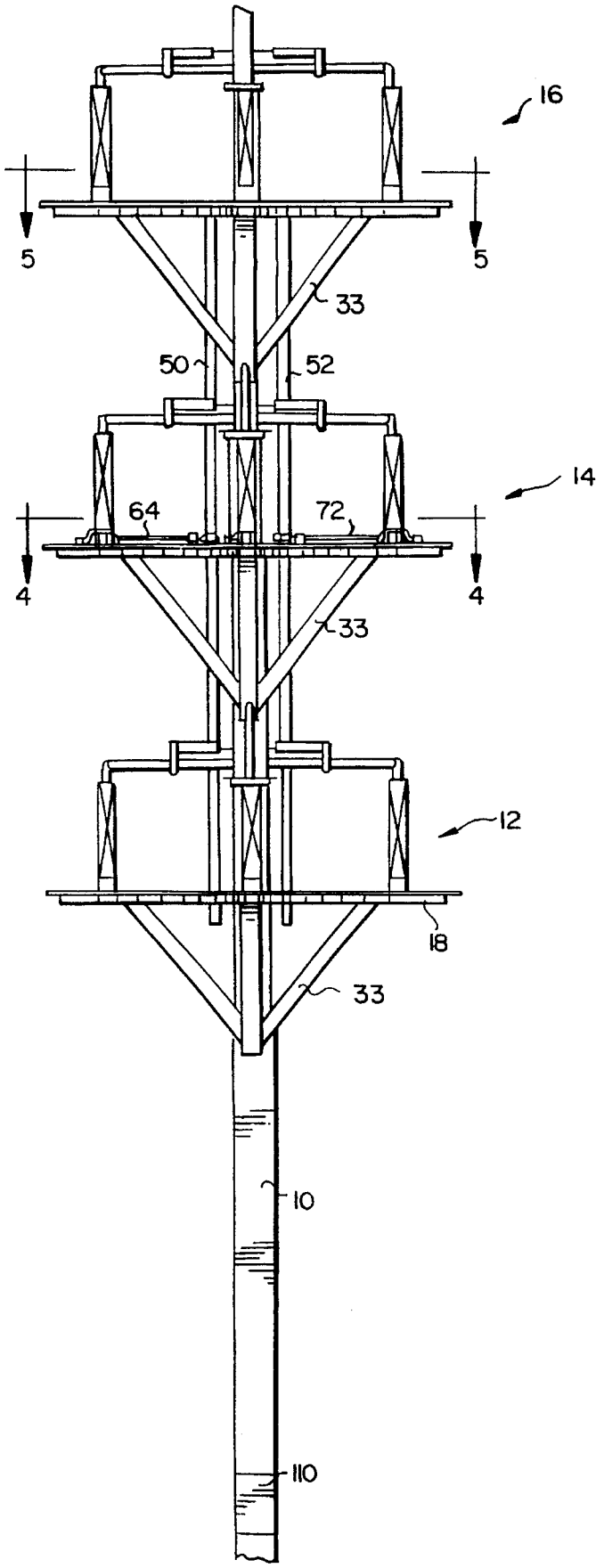
FIG. 1 is an elevational view of a three-phase power supply distribution system on an overhead pole.

Referring now to FIG. 1, there is illustrated a power line distribution pole 10 for carrying power transmission lines, not shown, in three phases at different elevations, respectively, for example, lower, intermediate and upper phases 12, 14 and 16, respectively. Each phase 12, 14 and 16 includes a support structure for the power lines, switches, insulators and associated elements. For example, the support structure at each phase includes a platform comprised of a main support 20 (FIG. 3) projecting horizontally from pole 10 having lateral support arms 22 and 24, as well as sides 26 and 28 connected between the ends of the lateral arms 22 and 24, respectively, and the distal end of main support 20. Suitable cross-bracing is provided, for example, at 30 and 32. The platform is supported by various inclined bracing 33 connected to the pole and platform as illustrated in FIG. 1. It will be appreciated that the platforms may comprise any suitable shape with various types of support structure, it being sufficient for present purposes to indicate that the platforms support each phase of the switch assemblies at the various elevations, as well as the associated equipment.

Figure 2:
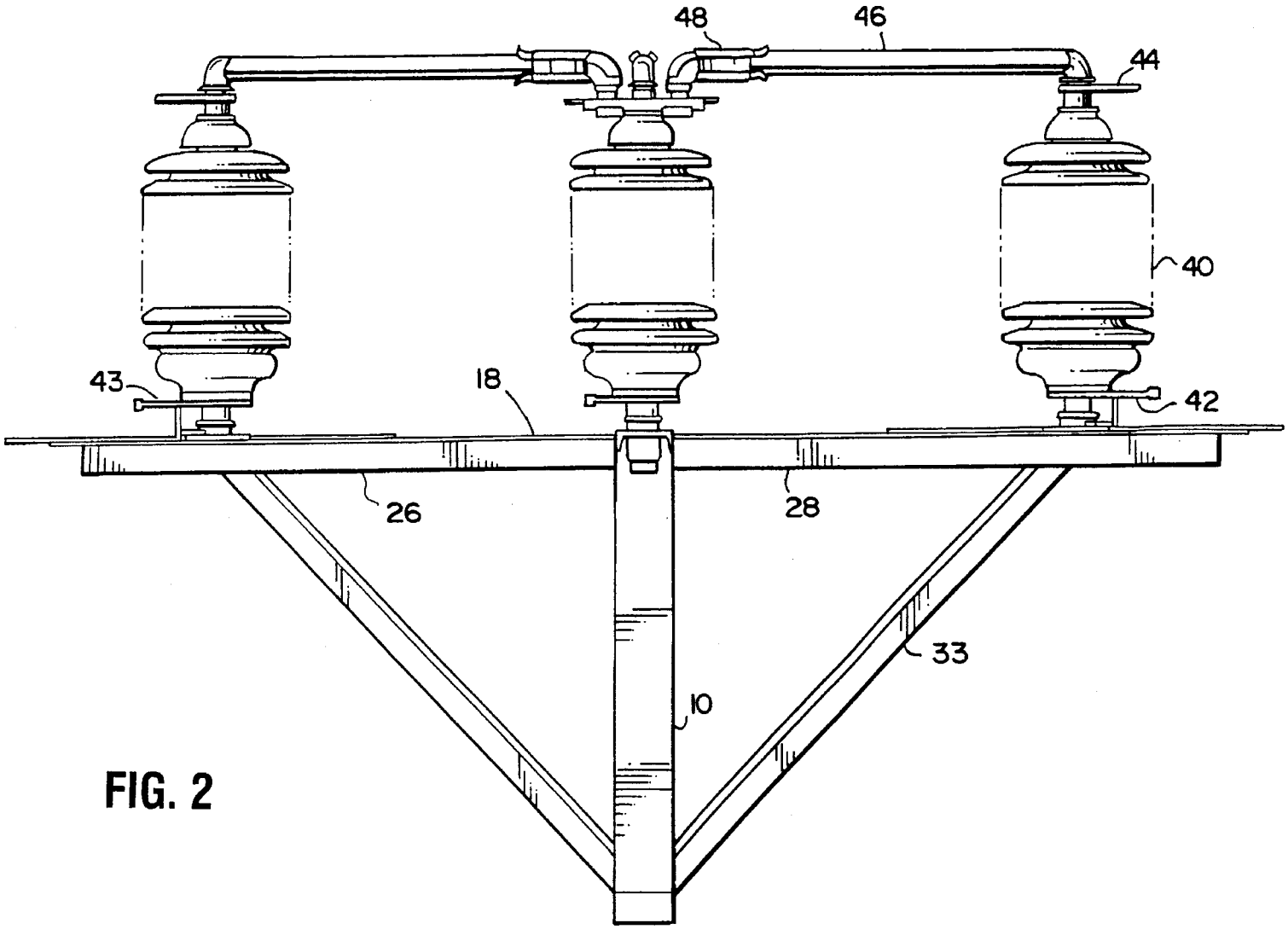
FIG. 2 is an enlarged elevational view of one of the phases.
Figure 3:
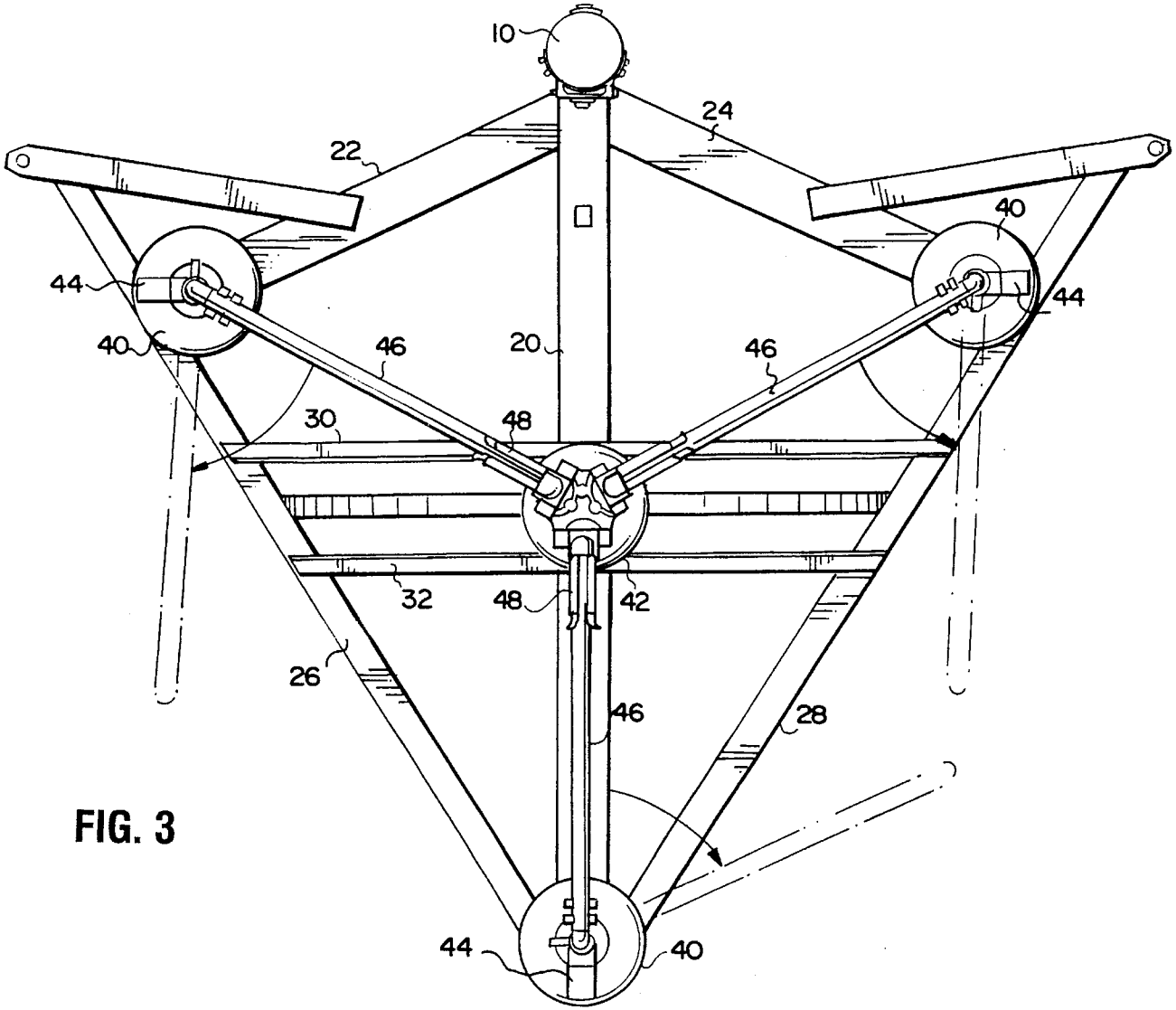
FIG. 3 is a plan view of the upper phase.

Referring now to FIGS. 2 and 3, the uppermost phase is illustrated, it being understood that the other phases insofar as elements corresponding to those illustrations of FIGS. 2 and 3 are concerned are identical thereto. In phase 16, the platform supports insulators 40, in this instance, in a triangular configuration about a center insulator 42, each insulator 40 being carried on a lever 43 rotatably mounted on the platform 18. The upper end of each insulator 40 includes an electrical terminal pad 44 for connection with a power line and a movable switch contact blade 46 extending between the terminal pad 44 and a central contact member or jaw 48 carried by the central insulator 42. Thus, each of the contact blades of each phase connects with an electrical terminal pad 44 supported by an insulator and with a central connection including the contact tube 48 whereby power may be distributed, for example, from one line to both of the other lines when connected. As best illustrated in FIG. 3, the movable contact blades are thus pivotally carried on levers 43 for movement between switch-closed positions as illustrated by the solid lines and switch-open positions illustrated by the dashed lines.

The present invention relates specifically to the mechanisms for displacing the movable contact blades between switch-open and switch-closed positions. To accomplish this, and referring to FIGS. 1 and 5, there is provided on the support structures associated with each phase 12, 14 and 16 three vertically extending shafts 50, 52 and 54. Shafts 50 and 52 are supported for rotation by outboard bearing plate assemblies 56 and 58 and central shaft 54 is supported by an outboard bearing plate assembly 60. At each elevation, each shaft 50, 52 and 54 is connected to a crank pivotally connected to a lever arm which, in turn, is pivotally connected to the associated lever 43 carrying the insulators and the movable contact blades. For example, at each phase, a crank 62 is coupled to the vertical shaft 50 and pivotally connected to a lever arm 64 by way of a fitting 66. The opposite end of lever arm 64 is pivotally connected by way of a similar fitting 68 to the lever 43. It will be appreciated from a review of FIG. 5 that a straight line drawn through the axis of vertical shaft 50 and the pivotal connection between fitting 68 and lever 43 is offset from the pivotal connection between lever 66 and crank 62. The crank rotation as described hereinafter is such that the pivotal connection between fitting 66 and crank 62 must pass overcenter to rotate the insulator and corresponding switch blade.

Figure 5:
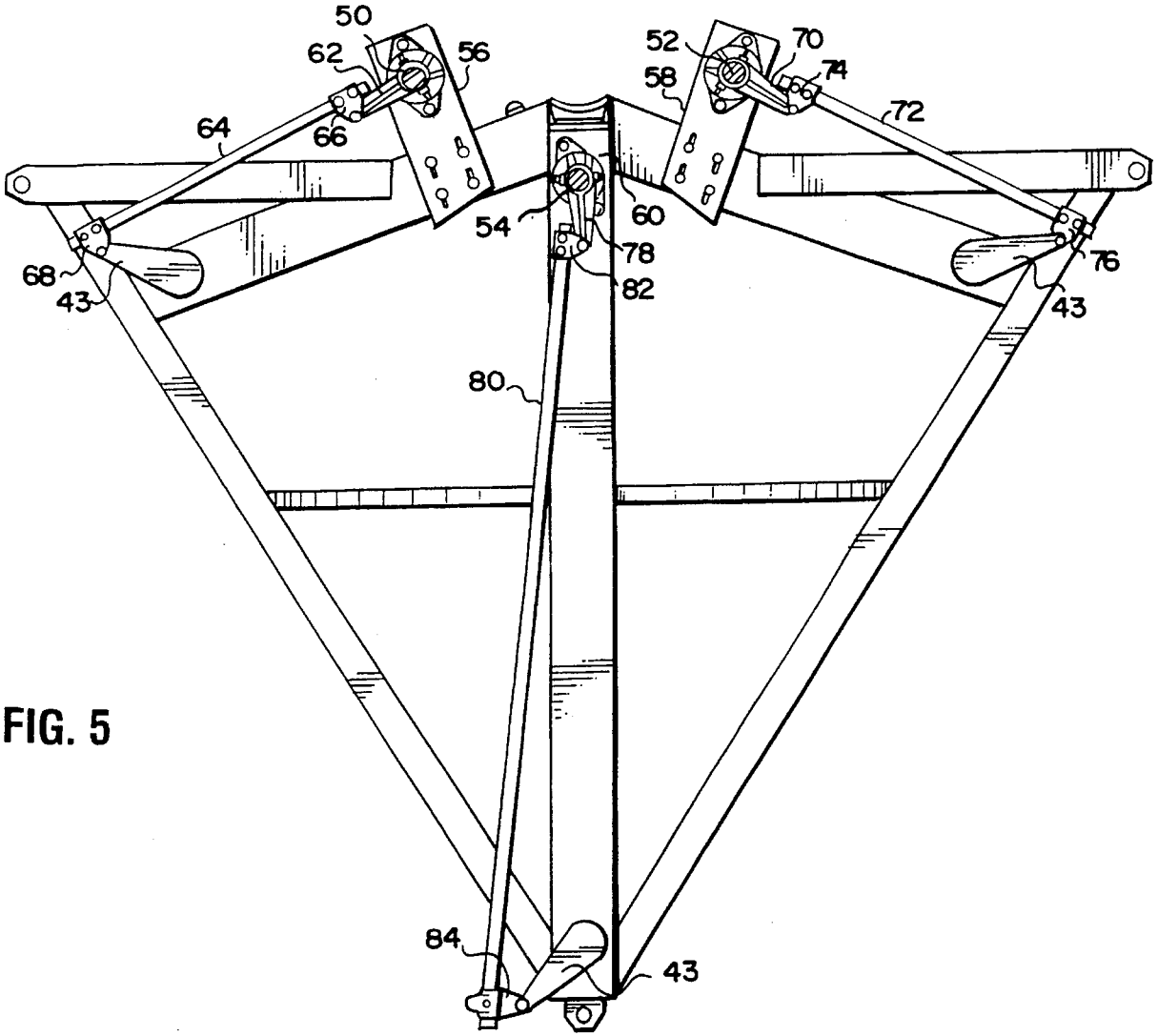
FIG. 5 is a cross-sectional view taken generally about on line 5—5 in FIG. 1.

The lever and crank assembly on the righthand side of FIG. 5 is similar as described for the left side. That is, the vertical shaft 52 mounts a crank 70 pivotally coupled to a lever arm 72 by way of a fitting 74, the opposite end of lever arm 72 being pivotally coupled by fitting 76 to a lever 43. In the closed position of the corresponding switch blade, a straight line through the axis of vertical shaft 52 and the pivotal connection between lever 43 and fitting 76 does not pass through the pivotal connection between fitting 74 and crank 70. Thus, in the switch-closed position, the crank lever assembly lies overcenter.

Also as illustrated in FIG. 5, a similar arrangement is illustrated with respect to the third insulator. For example, the crank 78 connected to vertical shaft 54 is pivotally connected to lever arm 80 by way of a fitting 82, the opposite end of lever arm 80 being pivotally connected to lever 43 by a fitting 84. As in the other crank lever assemblies, the pivotal axis between crank 78 and fitting 82 lies to one side of a straight line passing through the axis of shaft 54 and the pivotal connection between fitting 84 and lever 43. Thus, it will be appreciated that rotation of shafts 50 and 54 in a clockwise direction and shaft 52 in a counterclockwise direction rotates the corresponding insulators and switch contact blades in corresponding directions, respectively, as illustrated in FIG. 3.

Figure 6:
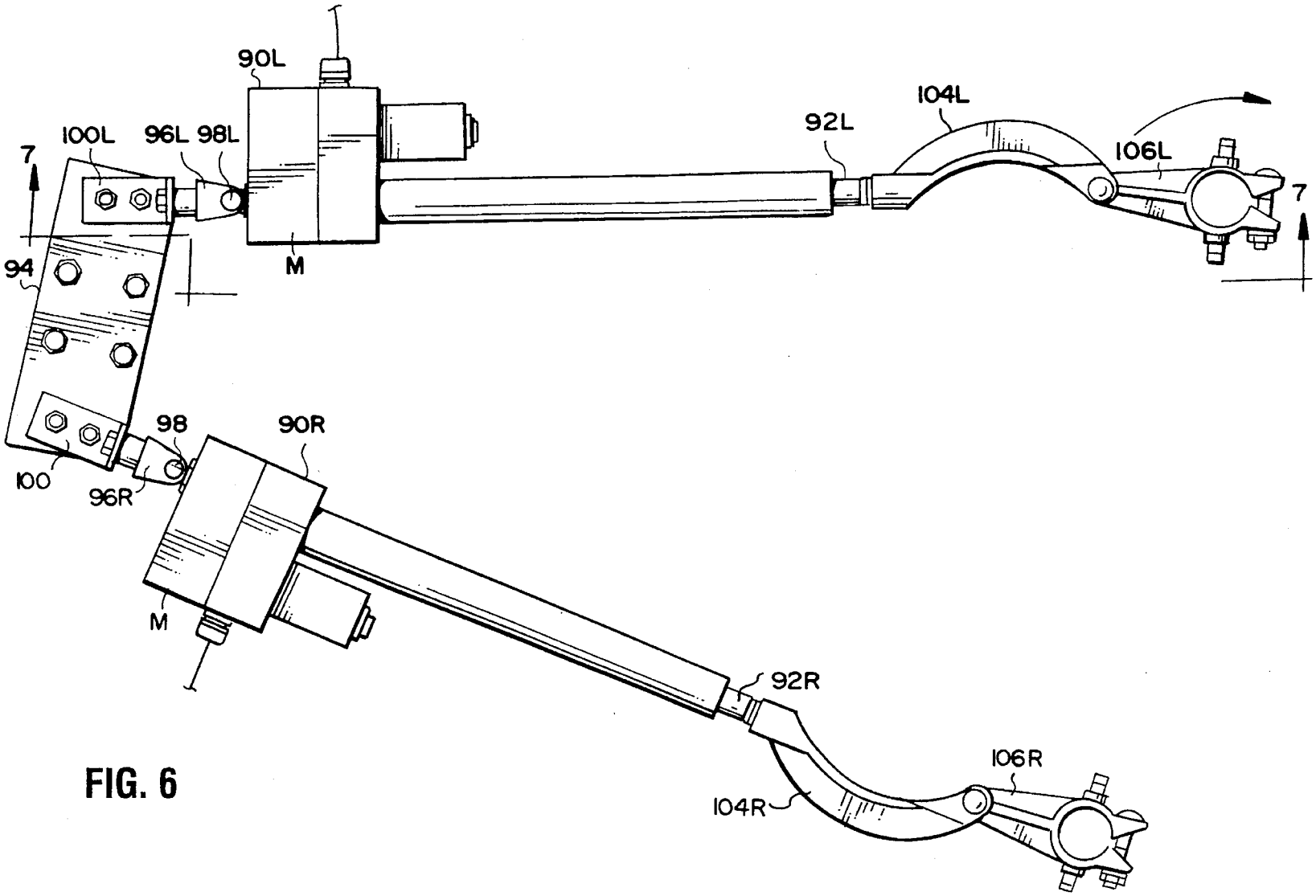
FIG. 6 is an enlarged plan view of two of the linear actuators and associated linkage for the intermediate phase.
Figure 7:
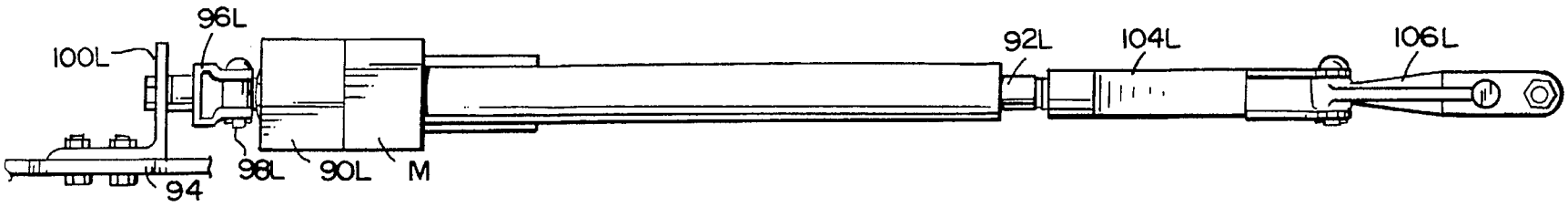
FIG. 7 is a cross-sectional view thereof taken generally about on line 7—7 in FIG. 6.
Figure 8:
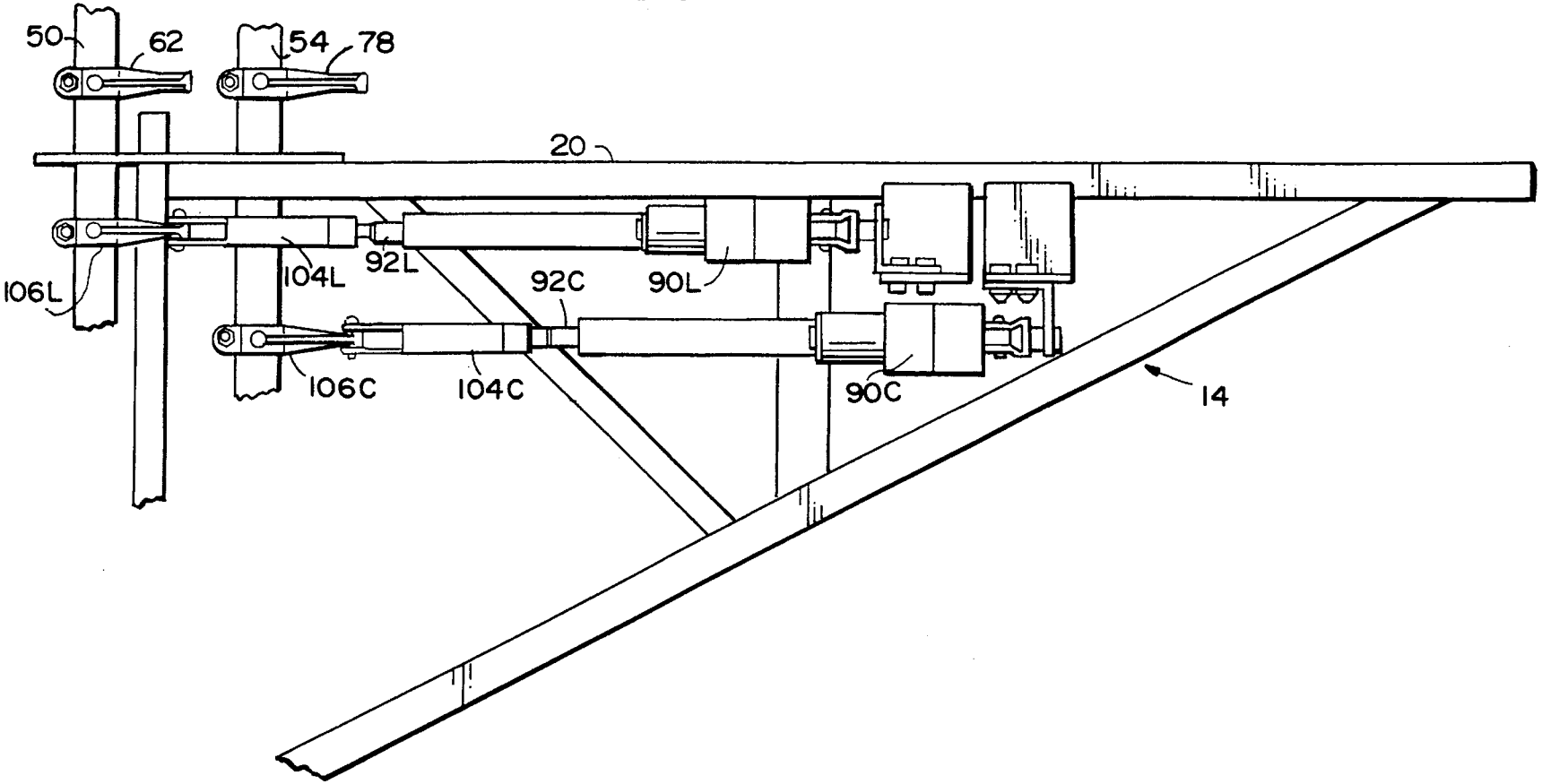
FIG. 8 is a reduced fragmentary side elevational view of the middle phase illustrating the linear actuators.

To rotate the shafts 50, 52 and 54, each shaft is coupled to an electrical linear actuator. Referring now to FIGS. 6–8, each electrically operated linear actuator comprises an electric motor M which drives a ballbearing screw drive system for linearly extending and retracting a shaft. Each linear actuator is preferably supported from the support structure at one of the phases, preferably the intermediate phase, by a bracket secured to the underside of the platform. Particularly, actuators 90L and 90R for rotating shafts 50 and 52, respectively, are pivotally coupled to bracket 94 through a clevis 96L, 96R, pin 98L, 98R and an angle bracket 100L and 100R secured to bracket 94. The linearly extensible and retractable shafts 92L, 92R mount at their forward ends very shallow, arcuate clevises 104L, 104R, respectively, the forward ends of which are pivotally coupled to crank arms 106L, 106R. Crank arms 106L, 106R are secured to a corresponding vertical shaft, i.e., one of shafts 50, 52. Thus, as illustrated in FIG. 6, linear actuator 90L is connected through the extensible and retractable shaft 92L, clevis 104L, and crank arm 106L to the vertical shaft 50. Linear actuator 90R is coupled between the support and the vertical shaft 52 through the extensible and retractable shaft 92R, clevis 104R and crank arm 106R. The third linear actuator 90C is preferably coupled to its associated shaft 54 by way of extensible and retractable shaft 92C, clevis 104C and crank arm 106C. Actuator 90C is carried by a bracket below actuators 90L, 90R and secured to the same support structure of the intermediate phase 14. From a review of FIG. 6, it will be appreciated that the pivot point between each of the clevises 104 and associated crank arms 106 lies offset from a straight line through the axis of the vertical shaft and the pivot axis of the associated linear actuator at pin 98. Consequently, when the linear actuators are actuated to extend their shafts, the crank arm 106L will rotate overcenter in a clockwise direction as illustrated in FIG. 6, the righthand crank arm 106R will rotate overcenter in a counterclockwise direction. Additionally, the crank arm 106C will rotate overcenter in a clockwise direction.

Referring back to FIG. 1, there is illustrated an electrical control panel 110 disposed adjacent the base of pole 10 and electrically coupled through various switches and by various electrical wiring, not shown, to each of the linear actuators 90. By closing one or more of the switches in the control panel, the linear actuators may be selectively actuated to move the switch blades to switch-open and switch-closed positions.

Figure 4:
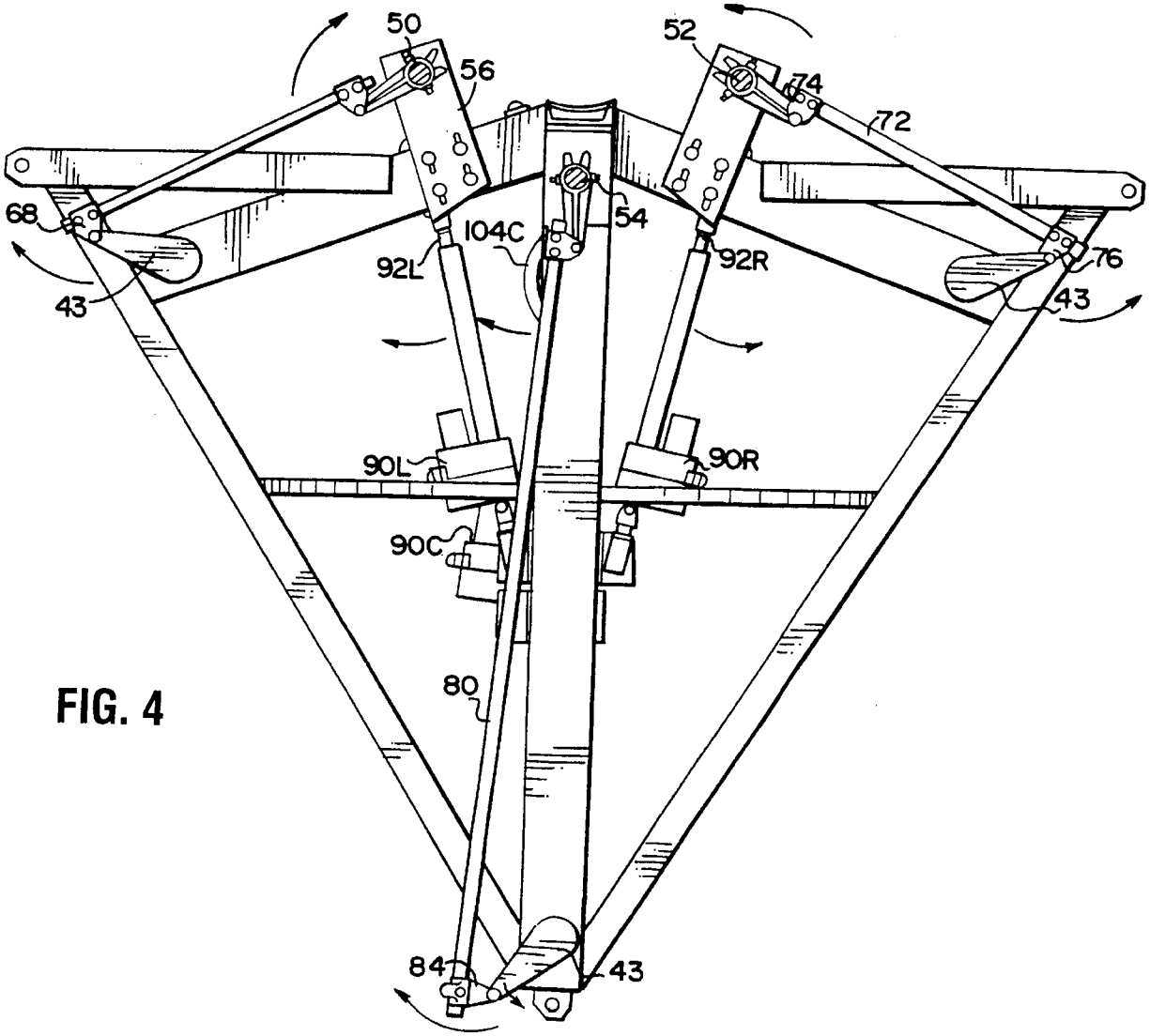
FIG. 4 is a cross-sectional view taken generally about on line 4—4 in FIG. 1.

In operation, actuation of linear actuator 90L causes shaft 92L to extend and, hence, rotate the first crank arm 106L in a clockwise direction as illustrated in FIG. 6, thus rotating shaft 50 similarly in a clockwise direction. Upon rotation of shaft 50, shaft 50 rotates at each elevation a crank 62 to move the pivot connection between it and fitting 66 over center whereby the lever 43 is rotated in a clockwise direction as illustrated in FIG. 5. By rotating lever 43 clockwise, the switch contact blade 46 carried thereby is moved from its closed position illustrated in FIG. 3 to its open position. The contact members or tubes 48 are similarly pivotally mounted such that the overcenter movement of the crank 62 is accommodated by initial and slight movement of the switch contact blade 46 in the opposite direction from its switch opening direction as illustrated. It will be appreciated that rotation of shaft 50 causes the switch contact blades 46 at each of the phases to simultaneously rotate between their switch-closed positions and switch-opened positions. Similarly, actuation of linear actuator 90R causes shaft 92R to extend and hence rotate crank arm 106R in a counterclockwise direction, thus rotating shaft 52 similarly at each elevation and hence rotating crank 70 to move the pivotal connection between it and fitting 74 overcenter whereby lever 43 is rotated in a counterclockwise direction. By rotating lever 43 by rotation of shaft 52 in a counterclockwise direction, the corresponding switch contact blade 46 similarly rotates counterclockwise from its switch-closed position with contact member 48 and an open position illustrated by the dashed lines in FIG. 3. The initial movement is, similarly as previously described, an overcenter movement such that the initial rotary movement is in a clockwise direction followed by the counterclockwise movement. Similarly, the linear actuator 90C causes shaft 92C to extend and hence rotate the crank arm 106C in a clockwise direction, thus rotating shaft 54 similarly in a clockwise direction as viewed in FIG. 4. Upon rotation of shaft 54, it rotates crank 78 to move the connection between crank 78 and fittings 82 overcenter whereby lever 43 is rotated in a clockwise direction as illustrated in FIG. 5. Thus, the switch contact blades 46 carried by levers 43 at the various phases are moved between their electrically closed positions and electrically opened positions. Contact members 48 are similarly pivotally mounted such that the overcenter movement of the crank 78 is accommodated by initial and slight movement of the switch contact blade 46 in the opposite or counterclockwise direction from its switch-opening direction as illustrated.

The arcuate nature of the clevises 104L, 104R and 104C permit extension of the shafts of the actuators such that rotation of the shafts may approach 180°, the arcuate nature of the clevises enabling the extended shafts to avoid interference with the vertical shafts. The linkage system, however, is oriented such that the degree of rotation of the switch blades is less than the rotation of the vertical shafts.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. For an overhead power line carried on a pole, an electrical circuit disconnect and connect apparatus for disposition adjacent an upper end of the pole comprising:

a rotatable contact blade and a contact member adapted to be positioned adjacent an upper end of the pole;

a vertically extending shaft rotatable about a generally vertical axis;

a linkage assembly coupling said shaft and said rotatable contact blade and operable to rotate said contact blade in response to rotation of said shaft;

an electrical/mechanical linear actuator for pivotal mounting on the upper end of the pole and having an electric motor and a driveshaft having an axis, said driveshaft being movable axially and linearly in response to electrical actuation of said motor;

connecting structure between said driveshaft and said vertical shaft, including a crank arm fixed to said vertical shaft and a clevis fixed to said driveshaft and pivotally coupled to said crank arm for rotating said vertical shaft to rotate said contact blade thereby to electrically connect and disconnect said contact blade and said contact member in response to actuation of said actuator and linear movement of said driveshaft, the axis of said driveshaft and the axis of said vertical shaft being offset from one another;

said linkage assembly including a crank fixed to said vertical shaft, a lever, and a lever arm pivotally coupled adjacent opposite ends to said crank and said lever, respectively, the pivotal connection between said crank and said lever arm lying overcenter relative to a straight line connecting the axis of said vertical shaft and the pivot between said lever and said lever arm when said connecting structure lies in a first orientation corresponding to one of an electrical connection and disconnection between said contact blade and said contact member, said pivotal connection between said crank and said lever arm being movable past center when said connecting structure lies in a second orientation corresponding to another of the electrical connection and disconnection between said contact blade and said contact member.

2. Apparatus according to claim 1 wherein, in one orientation of said connecting structure corresponding to an electrical connection and disconnection between said blade and said contact member, said clevis lies between said vertical shaft and said driveshaft with the pivot between said clevis and crank lying to one side of the axis of said vertical shaft.

3. Apparatus according to claim 2 wherein the clevis has a mid-portion offset from the axis of said driveshaft such that, in another orientation of said connecting structure corresponding to another of said electrical connection and disconnection between said blade and said contact member, said clevis lies on a side of said vertical shaft remote from said driveshaft with said mid-portion affording clearance between said clevis and said vertical shaft.

4. Apparatus according to claim 1, including said pole, said pole having a base, and an electrical control panel for location adjacent the base of the pole and an electrical coupling between said panel and said linear actuator for electrically actuating said linear actuator from said panel.

5. Apparatus according to claim 1 including a second rotatable blade and a second contact member adapted to be positioned adjacent an upper end of said pole, a second vertically extending shaft rotatable about a vertical axis, a second linkage assembly coupling said second shaft and said second rotatable contact blade and operable to rotate said second rotatable contact blade in response to rotation of said second shaft, a second electrical/mechanical linear actuator for pivotal mounting adjacent an upper end of the pole, said second actuator having a second electrical motor and a second driveshaft movable axially and linearly in response to electrical actuation of said second motor, second connecting structure between said second driveshaft and said second vertical shaft including a second crank fixed to said second vertical shaft and a second clevis fixed to said second driveshaft and pivotally coupled to said second crank for rotating said second vertical shaft to rotate said second contact blade thereby to electrically connect and disconnect the second contact blade and said second contact member in response to actuation of said second actuator and linear movement of said second driveshaft, the axis of said second driveshaft and the axis of said second vertical shaft being offset from one another.

6. Apparatus according to claim 5 including a third rotatable blade and a third contact member adapted to be positioned adjacent an upper end of said pole, a third vertically extending shaft rotatable about a vertical axis, a third linkage assembly coupling said third shaft and said third rotatable contact blade and operable to rotate said third rotatable contact blade in response to rotation of said third shaft, a third electrical/mechanical linear actuator for pivotal mounting adjacent an upper end of the pole, said third actuator having a third electrical motor and a third driveshaft movable axially and linearly in response to electrical actuation of said third motor, third connecting structure between said third driveshaft and said third vertical shaft including a third crank fixed to said third vertical shaft and a third clevis fixed to said third driveshaft and pivotally coupled to said third crank for rotating said third vertical shaft to rotate said third contact blade thereby to electrically connect and disconnect said third contact blade and said third contact member in response to actuation of said third actuator and linear movement of said third driveshaft, the axis of said third driveshaft and the axis of said third vertical shaft being offset from one another.

7. Apparatus according to claim 6 wherein said third linkage assembly includes a third crank fixed to said third vertical shaft, a third lever, and a third lever arm pivotally coupled adjacent opposite ends to said third crank and said third lever, respectively, the pivotal connection between said third crank and said third lever arm lying overcenter relative to a straight line connecting the axis of said third vertical shaft and the pivot between said third lever and said third lever arm when said third connecting structure lies in a first orientation corresponding to one of an electrical connection and disconnection between said third contact blade and said third contact member, said pivotal connection between said third crank and said third lever arm being movable past center when said third connecting structure lies in a third orientation corresponding to another of the electrical connection and disconnection between said third contact blade and said third contact member.

8. Apparatus according to claim 6 including said pole each of said first, second and third electrical/mechanical linear actuators lying adjacent an upper end of the pole at like elevations therealong.

9. Apparatus according to claim 5 wherein said second linkage assembly includes a second crank fixed to said second vertical shaft, a second lever, and a second lever arm pivotally coupled adjacent opposite ends to said second crank and said second lever, respectively, the pivotal connection between said second crank and said second lever arm lying overcenter relative to a straight line connecting the axis of said second vertical shaft and the pivot between said second lever and said second lever arm when said second connecting structure lies in a first orientation corresponding to one of an electrical connection and disconnection between said second contact blade and said second contact member, said pivotal connection between said second crank and said second lever arm being movable past center when said second connecting structure lies in a second orientation corresponding to another of the electrical connection and disconnection between said second contact blade and said second contact member.

10. Apparatus according to claim 5 including said pole said first and second electrical/mechanical linear actuators lying adjacent an upper end of the pole at like elevations therealong.

11. For an overhead power line carried on a pole, electrical circuit disconnect and connect apparatus for positioning adjacent an upper end of said pole comprising:

first and second phases adapted to be positioned adjacent an upper end of the pole and elevationally spaced from one another, each phase including a rotatable contact blade and a contact member;

a vertically extending shaft adapted to be carried by the pole for rotation about a generally vertical axis and extending between said phases;

first and second linkage assemblies coupling said shaft and the respective movable contact blades of the phases for jointly rotating said contact blades of the first and second phases in response to rotation of said vertical shaft;

an electrical/mechanical linear actuator adapted to be carried by the pole adjacent the upper end of the pole and having an electric motor and a driveshaft movable axially and linearly in opposite directions in response to electrical actuation of the motor; and connecting structure between said driveshaft and said vertical shaft, including a crank arm fixed to said vertical shaft and a clevis fixed to said driveshaft and pivotally coupled to said crank arm for rotating said vertical shaft and said contact blades to substantially simultaneously electrically connect the contact blades and contact members of said phases, respectively, and to substantially simultaneously electrically disconnect the control blades and contact members of said phases, respectively in response to actuation of said actuator and linear movement of said driveshaft in respective opposite directions.

12. Apparatus according to claim 11 including a third phase adapted to be positioned adjacent an upper end of the pole and at a different elevation than the first and second phases, said third phase including a rotatable contact blade and a contact member, a third linkage assembly coupling said vertical shaft and the third movable contact blade for rotating said third contact blade substantially simultaneously with rotation of said first and second contact blades in response to rotation of said vertical shaft.

13. Apparatus according to claim 11 wherein each of said first and second linkage assemblies includes a crank fixed to said vertical shaft, a lever and a lever arm pivotally coupled adjacent opposite ends to said crank and said lever, respectively, the pivotal connection between said crank and said lever arm lying overcenter relative to a straight line connecting the axis of said vertical shaft and the pivot between said lever and said lever arm when said connecting structure lies in a first orientation corresponding to one of an electrical connection and disconnection between said contact blade and said contact member of each phase, said pivotal connection between said crank and said lever arm being movable past center when said connecting structure lies in a second orientation corresponding to another of the electrical connection and disconnection between said contact blade and said contact member at each phase, respectively.

14. For an overhead power line carried on a pole, an electrical circuit disconnect/connect apparatus for disposition adjacent an upper end of the pole comprising:

a rotatable contact blade and a contact member adapted to be positioned adjacent an upper end of the pole;

a vertically extending shaft rotatable about a generally vertical axis;

a linkage assembly coupling said shaft and said rotatable contact blade and operable to rotate said contact blade in response to rotation of said shaft;

an electrical/mechanical linear actuator for pivotal mounting on the upper end of the pole and having an electric motor and a driveshaft having an axis and movable axially and linearly in response to electrical actuation of said motor;

connecting structure between said driveshaft and said vertical shaft, including a crank arm fixed to said vertical shaft and a clevis fixed to said driveshaft and pivotally coupled to said crank arm for rotating said vertical shaft to rotate said contact blade between extreme positions thereby to electrically connect and disconnect said contact blade and said contact member in response to actuation of said actuator and linear movement of said driveshaft, the axis of said driveshaft and the axis of said vertical shaft being offset from one another with the pivotal coupling between said clevis and said crank arm being movable along an arc substantially 180° between opposite sides of said vertical shaft when the contact blade is rotated between said extreme positions.

15. Apparatus according to claim 14 wherein said clevis is arcuate in configuration in a plane generally normal to the axis of the vertical shaft to avoid interference with said vertical shaft.

* * * * *